US011857066B2

(12) United States Patent
Russo

(10) Patent No.: US 11,857,066 B2
(45) Date of Patent: Jan. 2, 2024

(54) CUSTOMIZABLE HAIRBRUSH

(71) Applicant: Ouidad Licensing LLC, Commack, NY (US)

(72) Inventor: Melissa Russo, Commack, NY (US)

(73) Assignee: Ouidad Licensing LLC, Commack, NY (US)

( * ) Notice: Subject to any disclaimer, the term of this patent is extended or adjusted under 35 U.S.C. 154(b) by 198 days.

(21) Appl. No.: 17/464,606

(22) Filed: Sep. 1, 2021

(65) Prior Publication Data

US 2023/0068038 A1 Mar. 2, 2023

(51) Int. Cl.

| | |
|---|---|
| ***A46B 7/04*** | (2006.01) |
| ***A46B 9/02*** | (2006.01) |
| ***A46B 17/06*** | (2006.01) |

(52) U.S. Cl.

CPC ..... *A46B 7/04* (2013.01); *A46B 9/023* (2013.01); *A46B 17/06* (2013.01); *A46B 2200/104* (2013.01)

(58) Field of Classification Search

CPC ..... A46B 7/04; A46B 9/02; A46B 17/06
See application file for complete search history.

(56) References Cited

U.S. PATENT DOCUMENTS

| | | | | |
|---|---|---|---|---|
| 1,375,755 | A * | 4/1921 | Hastings | A46B 5/00 300/21 |
| 1,586,751 | A | 6/1926 | Kellogg | |
| 1,633,894 | A * | 6/1927 | Kellogg | A46B 15/00 15/202 |
| 1,831,667 | A | 11/1931 | Johnson | |
| 2,238,603 | A | 4/1941 | Runnels | |
| 2,845,642 | A * | 8/1958 | Inman | A45D 24/42 15/160 |
| 2004/0065337 | A1 | 4/2004 | Wang | |
| 2015/0074929 | A1 * | 3/2015 | White | A46B 17/06 15/169 |

FOREIGN PATENT DOCUMENTS

| | | | |
|---|---|---|---|
| GB | 656877 | A | 9/1951 |
| KR | 20190136732 | A | 12/2019 |
| WO | WO2015161922 | A1 | 10/2015 |

OTHER PUBLICATIONS

PCT Search Report and Written Opinion for PCT/US22/42057, USPTO Searching Authority, dated Jan. 4, 2023.

* cited by examiner

*Primary Examiner* — Michael D Jennings
(74) *Attorney, Agent, or Firm* — Gloria Tsui-Yip; Gottlieb, Rackman & Reisman, P.C.

(57) ABSTRACT

A hairbrush includes a base with a handle and an elongated end portion connected to the handle. The elongated end portion includes a plurality of slots extending inwardly from a front side surface of the elongated end portion and a cavity extending inwardly from a lateral side surface of the elongated end portion. The cavity and the slots extend in different directions and intersect one another inside of the elongated end portion of the base. The hairbrush also includes a locking bar with through holes extending in the cavity and movable between a first position and a second position inside of the cavity. The hairbrush may further include a plurality of bristle structures, insertable into the slots and the through holes of the locking bar, and selectively coupleable to the elongated end portion of the base by moving the locking bar to one of the first and second positions thereof.

19 Claims, 12 Drawing Sheets

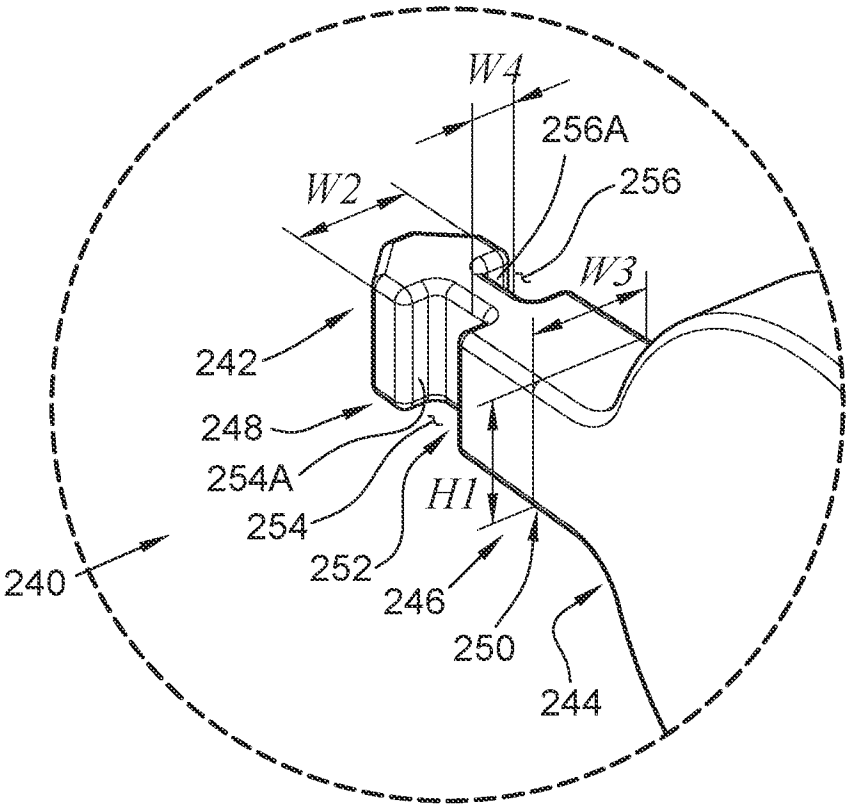
FIG.3
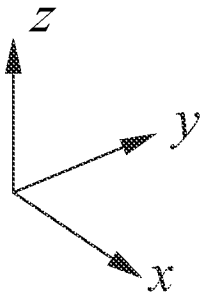

CUSTOMIZABLE HAIRBRUSH

TECHNICAL FIELD

The present invention relates to a hairbrush, and more particularly, to a hairbrush that can be customized by selectively attaching bristle structures thereto.

DISCUSSION OF THE RELATED ART

Hairbrushes come in different types, shapes and sizes. Some hairbrushes on the market are adjustable, but their degree of adjustability is limited. For example, known customization mechanisms typically involve detaching the entire head portion of a brush handle and replacing it with a different kind of a brush head. Other customizable hairbrush configurations feature a removable cushion with bristles permanently attached thereto. In this case, the cushion can be detached together with the bristles, and can be replaced with a different cushion featuring different bristles.

Thus, when a user desires to change his or her hair style, the user may replace the entire hairbrush head or just the cushion part of the hairbrush with one that is most suitable for the user's specific hair styling needs. A professional hairdresser would need to stock a relatively large number of different hairbrush heads or cushions with different bristles in order to accommodate the needs of a diverse clientele.

However, this approach might not be economically feasible due to the large expenditure associated with purchasing numerous brush heads and/or cushions with bristles. In addition, since a user can utilize only one hairbrush head or cushion with bristles at a time, the remainder of the brush heads or cushions would need to be stored away, thereby requiring a large amount of storage space.

SUMMARY

It is an object of the present invention to provide a highly customizable hairbrush that includes a base and a plurality of bristle structures that are selectively connectable to the base. The base includes a handle and an elongated receiving end portion connected to the handle. The elongated receiving end portion extends laterally to a length direction of the handle.

The receiving end portion of the base has a plurality of insertion slots extending inwardly into the base (e.g., toward the handle) from a front side surface of the receiving end portion (e.g., from a side surface of the receiving end portion that faces the bristle structures), and a cavity with a closed end that extends inwardly into the base from a lateral side surface of the receiving end portion (e.g., a left side or a right side of the receiving end portion). The insertion slot and the cavity extend in different directions inside of the receiving end portion of the base, and intersect one another inside of the receiving end portion of the base.

Each bristle structure may have an elongated body with a plurality of bristle elements attached thereto and an elongated tail end (or elongated member, as referred to below), connected to the body. The tail end of each bristle structure is configured to be inserted in any one of the insertion slots of the receiving end portion of the base. The tail end of each bristle structure includes at least one notch along its length.

The base of the hairbrush further includes a locking bar inserted in the cavity of the receiving end portion of the base. The locking bar can be slid in a length direction of the cavity between a first position and a second positon in order to selectively allow the tail ends of the bristle structures to be inserted in or removed from the insertion slots, and to maintain the inserted bristle structures selectively locked to the receiving end portion of the base. The locking bar has a plurality of cut-out windows (or through openings) along its length, and wall portions disposed between the cut-out windows (or at a side of each cut-out window).

When the locking bar is in the first position, the cut-out windows are aligned with the insertion slots, thereby enabling the tail ends of the bristle structures to be inserted in or removed from the insertion slots (and through the cut-out windows).

When the locking bar is in the second position, the cut out windows become shifted relative to their location when the locking bar is in the first position, and the shifting causes the wall portions of the locking bar to protrude into their respective insertion slots and into a notch of each tail end of each bristle structure that is inserted in each slot. When the wall portions of the locking bar are inserted in (or protrude in) the notches, the wall portions prevent the bristle structures from being removed from the base.

The locking bar may also include a spring biasing it toward the second positon. Thus, during normal operation, the bristle structures will selectively locked to the receiving end portion of the base. The locking bar can also be provided with a thumb button accessible from the lateral side surface of the receiving end portion such that a user can depress the button to slide the locking bar to the first position when desiring to remove or add bristle structures to the base.

Thus, a hairbrush of the present invention can be selectively loaded with a desired number of bristle structures or different types of bristles structures to customize the hairbrush for use with different hair styles, types, texture, etc.

BRIEF DESCRIPTION OF THE DRAWINGS

The above and other features of the present invention will become more apparent by describing in detail exemplary embodiments thereof in conjunction with the accompanying drawings, in which:

FIG. 3 is a perspective view illustrating a magnified region A of FIG. 2;

DETAILED DESCRIPTION OF THE EMBODIMENTS

Figure 1:
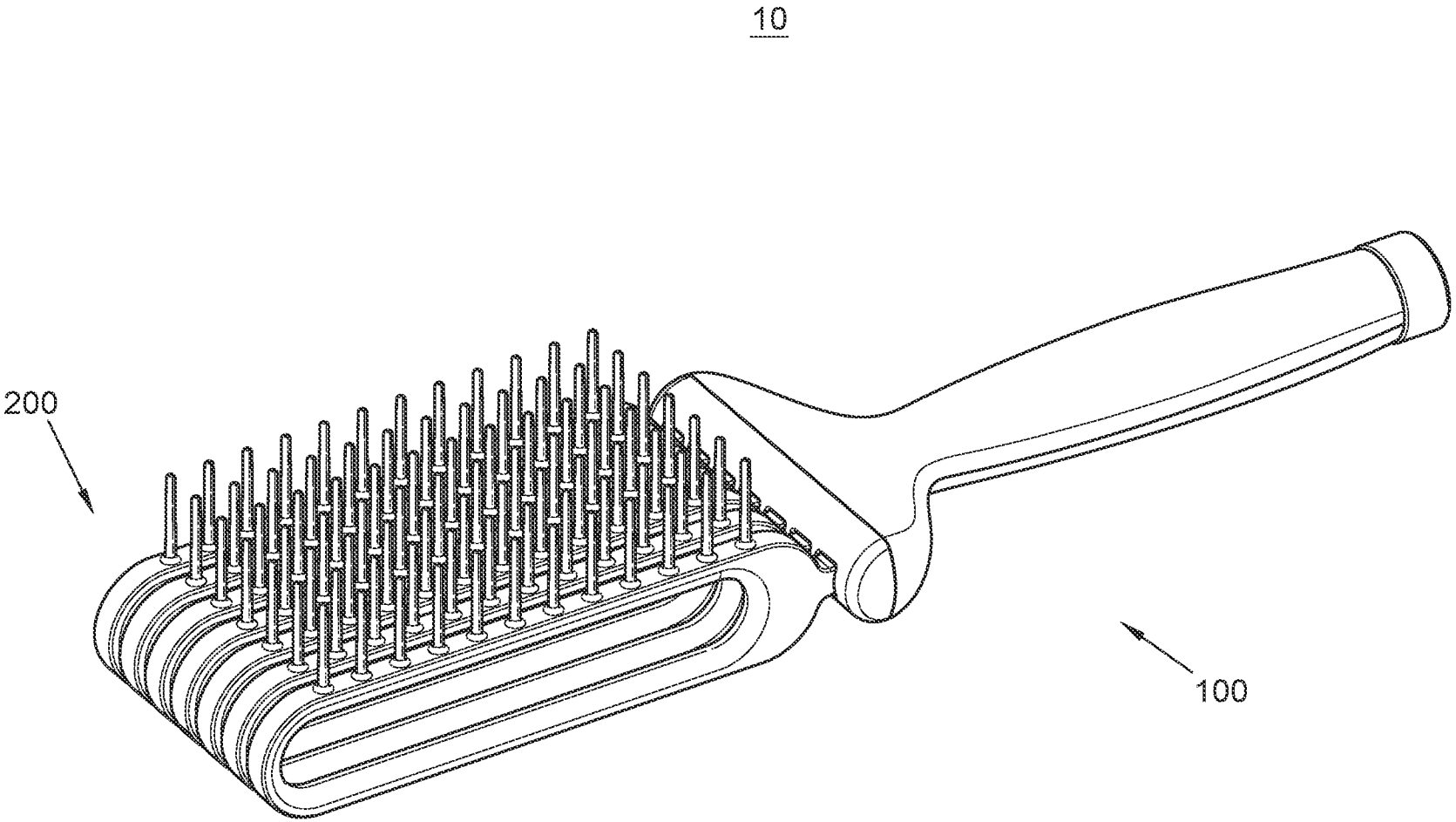
FIG. 1 is a perspective view illustrating a hairbrush according to an exemplary embodiment of the present invention.

Exemplary embodiments of the present invention will be described more fully hereinafter with reference to the accompanying drawings. The present invention may, however, be embodied in different forms and should not be construed as being limited to the embodiments set forth herein. Like reference numerals may refer to like elements throughout the specification. The sizes and/or proportions of the elements illustrated in the drawings may be exaggerated for clarity.

When an element is referred to as being disposed on another element, intervening elements may be disposed therebetween. In addition, elements, components, parts, etc., not described in detail with respect to a certain figure or embodiment may be assumed to be similar to or the same as corresponding elements, components, parts, etc., described in other parts of the specification. In addition, the dimensions illustrated in the drawings are non-limiting.

FIGS. 1-8 illustrate a hairbrush according to an exemplary embodiment of the present invention.

Figure 2:
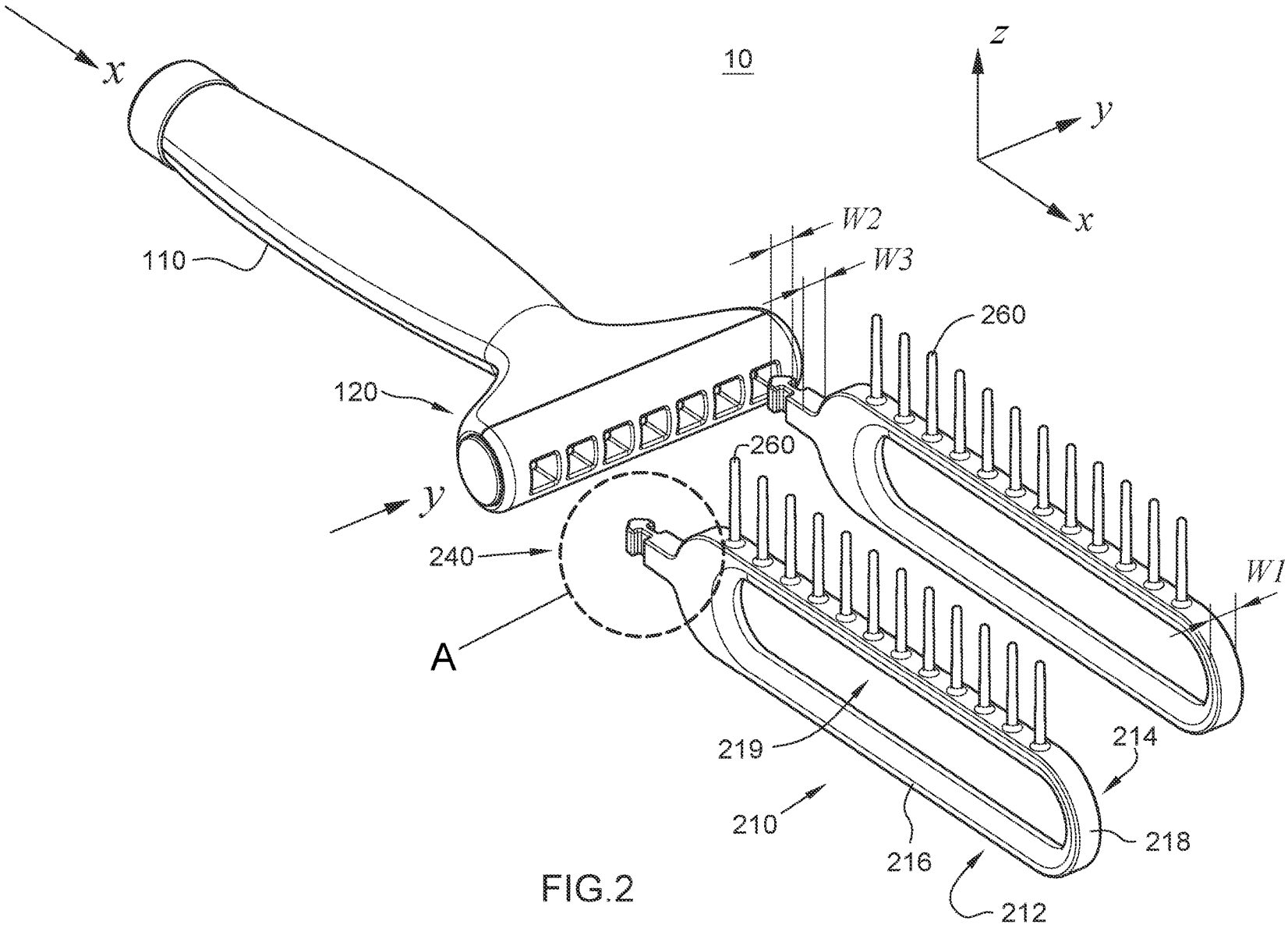
FIG. 2 is a partially exploded perspective view illustrating the hairbrush of FIG. 1 with some bristle structures omitted.

Referring to FIG. 1, the hairbrush 10 includes a base 100 and a plurality of bristle structures 200 that are selectively connectable to the base 100. Referring to FIG. 2, the base 100 includes a handle 110 extending substantially in a first direction X and an elongated end portion 120 connected to the handle 110.

As illustrated in FIG. 2, the end portion 120 of the base 100 extends substantially in a second direction Y. Referring to FIG. 2, the first and second directions X and Y cross one another. For example, the first and second directions X and Y intersect one another at a right angle.

However, the present invention is not limited to this configuration, and the handle 110 and the end portion 120 of the base 100 can be arranged to extend at angles other than 90 degrees with respect to one another. For example, the handle 110 and the end portion 120 can be configured to extend at an oblique angle with respect to one another.

As can be gleaned with reference to FIGS. 1-8, the bristle structures 200 are configured to be selectively connected to the end portion 120 of the base 100. Referring to FIG. 2, each bristle structure 200 may include a hollow body 210, an elongated member 240 connected to the hollow body 210, and a plurality of bristle elements 260 connected to the hollow body 210.

Referring to FIG. 2, the hollow body 210 of each bristle structure 200 may have a first open end 212, a second open end 214 and a sidewall 216 extending between the first and second open ends 212 and 214. As illustrated in FIG. 2, the sidewall 216 of the hollow body 210 of each bristle structure 200 may have an outer surface 218, and may define a through opening 219 in the hollow body 210.

As illustrated in FIG. 2, the sidewall 216 may extend lengthwise substantially in the first direction X, and may have a width W1 measured in the second direction Y. As illustrated in FIG. 2, the width W1 may be uniform across the length of the sidewall 216, but the present invention is not limited to this configuration. For example, the sidewall 216 can also be manufactured with a width that varies along the length of the sidewall 216.

In each bristle structure 200, as illustrated in FIG. 2, the bristle elements 260 may be spaced apart from one another and may be arranged consecutively along the length of the sidewall 216 (e.g., arranged in the first direction X). As illustrated in FIG. 2, the bristle elements 260 of each bristle structure 200 may be connected to the outer surface 218 and may extend substantially perpendicularly to the outer surface 218. For example, as illustrated in FIG. 2, the bristle elements 260 may extend substantially in a third direction Z. The third direction Z crosses the first and second directions X and Y and may be, for example, perpendicular to each one of the first and second directions X and Y.

Each bristle element 260 on each bristle structure 200 may include one individual brush tip, or a tuft of bristles (e.g., a plurality of boar's hairs bundled together), or a combination of different types of bristle elements.

When a bristle element 260 includes one brush tip, the brush tip may be made of a natural material or a synthetic material. When a bristle element 260 includes a tuft of bristles, the tuft may contain bristles made of natural material, bristles made of a synthetic material, or a combination natural and synthetic bristles.

Examples of a natural material from which a bristle can be made include animal hair, wood, plant material (e.g., plant fiber), and a feather. Suitable types of animal hair for making a bristle include, for example, equine hair (e.g., horse or zebra hair), bovine hair, goat hair, donkey/mule hair, camel hair, llama hair, boar/swine hair, badger hair, mink hair, sable hair, etc.

A bristle made of a synthetic material may contain, for example, nylon, polyester, polyurethane, polyvinyl chloride (PVC), polycarbonate, polyethylene terephthalate (PET), etc., or a blend thereof. The present invention is not limited to the above-recited examples of natural and synthetic bristles.

While it is illustrated in FIGS. 1-4 and 7-8 that all of the bristle elements 260 in a bristle structure 200 can be the same as one another, the present invention is not limited to this configuration. For example, any one of the bristle structures 200 can also be manufactured to contain bristle elements 260 that are different from one another. For example, a first bristle element 260 in a bristle structure 200 may include a bristle that is longer or shorter, thicker or thinner, stiffer or more flexible, having a different cross-sectional shape, a different profile shape, and/or made of a different material than a bristle included in a second bristle element 260 of the same bristle structure 200.

The material, shape and dimensions of each bristle that is included in each bristle element 260 of each bristle structure 200 can be varied as needed in order to achieve a bristle element 260 of a desired length and with a desired degree of flexibility.

While the spacing between bristle elements 260 can be uniform, as illustrated in FIGS. 1-4 and 7-8, the present invention is not limited to this configuration. For example, the spacing between bristle elements 260 in each bristle structure 200 can be varied as needed. As an example, each bristle structure 200 can have a first pair of bristle elements 260 that are disposed immediately adjacent to one another (e.g., not spaced apart from one another) and a second pair of bristle openings that are spaced apart from one another.

FIGS. 1-4 and 7-8 illustrate that a bristle structure 200 may have twelve bristle elements 260, but the present invention is not limited to this configuration. For example, each bristle structure 200 may include less than twelve bristle elements 260, or more than twelve bristle elements 260, as desired.

Referring to FIGS. 1-4 and 7-8, the elongated member 240 may have approximately a cuboid shape extending substantially in the first direction X, and may be connected to the sidewall 216 of the hollow body 210 of each bristle structure 200.

As more clearly illustrated in FIG. 3, the elongated member 240 may have a first end 242, a second end 244, and a body 246 extending substantially in the first direction X between the first and second ends 242 and 244. In other words, the length of the body 246 may be measured in the first direction X. The body 246 has a height H1 measured in the third direction Z.

Referring to FIG. 3, the body 246 of the elongated member 240 may include a first body portion 248 disposed adjacent to the first end 242, a second body portion 250 disposed adjacent to the second end 244, and a third portion 252 disposed between the first and second body portions 248 and 250.

Referring to FIG. 3, the first body portion 248 may have a width W2 and the second body portion 250 may have a width W3, both measured in the second direction Y. Referring to FIG. 3, the widths W2 and W3 may be the same as one another, but the present invention is not limited to this configuration. For example, in a different configuration, the width W2 of the first body portion 248 may be smaller than the width W3 of the second body portion 250.

Referring to FIG. 3, the height H1 may be uniform across the length of each elongated member 240. However, the present invention is not limited to this configuration. For example, in a different configuration, the height H1 of the body 246 of the elongated member 240 of any one of the bristle structures 200 may vary at different points along the length of the body 246. As an example, a height (e.g., H1) of the second body portion 250 may be equal to or greater than a height of the third body portion 252 (both heights measured in the third direction Z), and a height of the third body portion 252 may be equal to or greater than a height of the first body portion 248 (both measured in the third direction Z).

Referring to FIG. 3, the third body portion 252 may include a first notch 254 with a forward facing surface 254A, and a second notch 256 with a forward facing surface 256A.

Referring to FIG. 3, the notches 254 and 256 may extend inwardly into the third body section 252 in the width direction of the elongated member 240. As illustrated in FIG. 3, the notches 254 and 246 may extend across an entire height of the third body portion 252 in the third direction Z.

Referring to FIG. 3, the third body portion 252 may have a width W4 that is smaller than the widths W2 and W3 due to the notches 254 and 256. The notches 254 and 256 of the third body portion 252 of the elongated member 240 of each bristle structure 200 are utilized to maintain each bristle structure 200 selectively connected to the end portion 120 of the base 100, as will be described below.

As can be gleaned with reference to FIGS. 1-8, the end portion 120 of the base 100 is configured to receive a part of the plurality of bristle structures 200 inside of it such that the bristle structures 200 can be selectively connected to the base 100.

While FIG. 1 illustrates that all of the bristle structures 200 can be the same as one another, the present invention is not limited to this configuration. The configuration of the bristle structures 200 can be varied as needed, and a plurality of bristle structures 200 having different bodies 210 (e.g., bodies 210 with a different shape, size and/or length as one another) can be coupled to the base 100. In addition, the different bristle structures 200 may have bristle elements 260 that are the same as one another, or different from one another. In other words, the number, length, type and spacing of the bristle elements 260 that may be connected to the base 100 may be varied as needed by a user. Thus, a hairbrush of the present invention can be customized precisely to the needs of each particular user or use.

Figure 4:
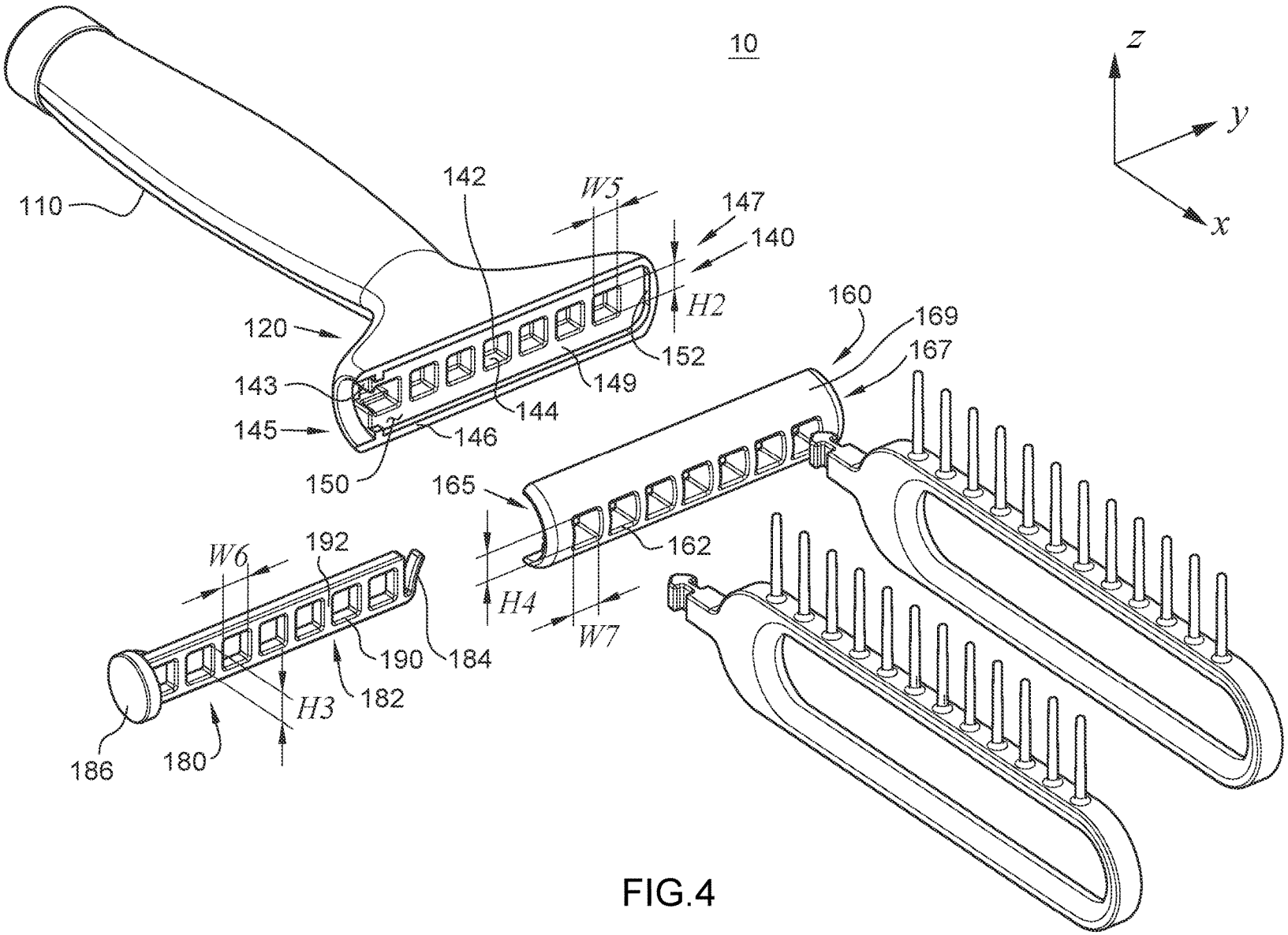
FIG. 4 is an exploded perspective view illustrating the hairbrush of FIG. 1 with some of the bristle structures omitted.
Figure 7:
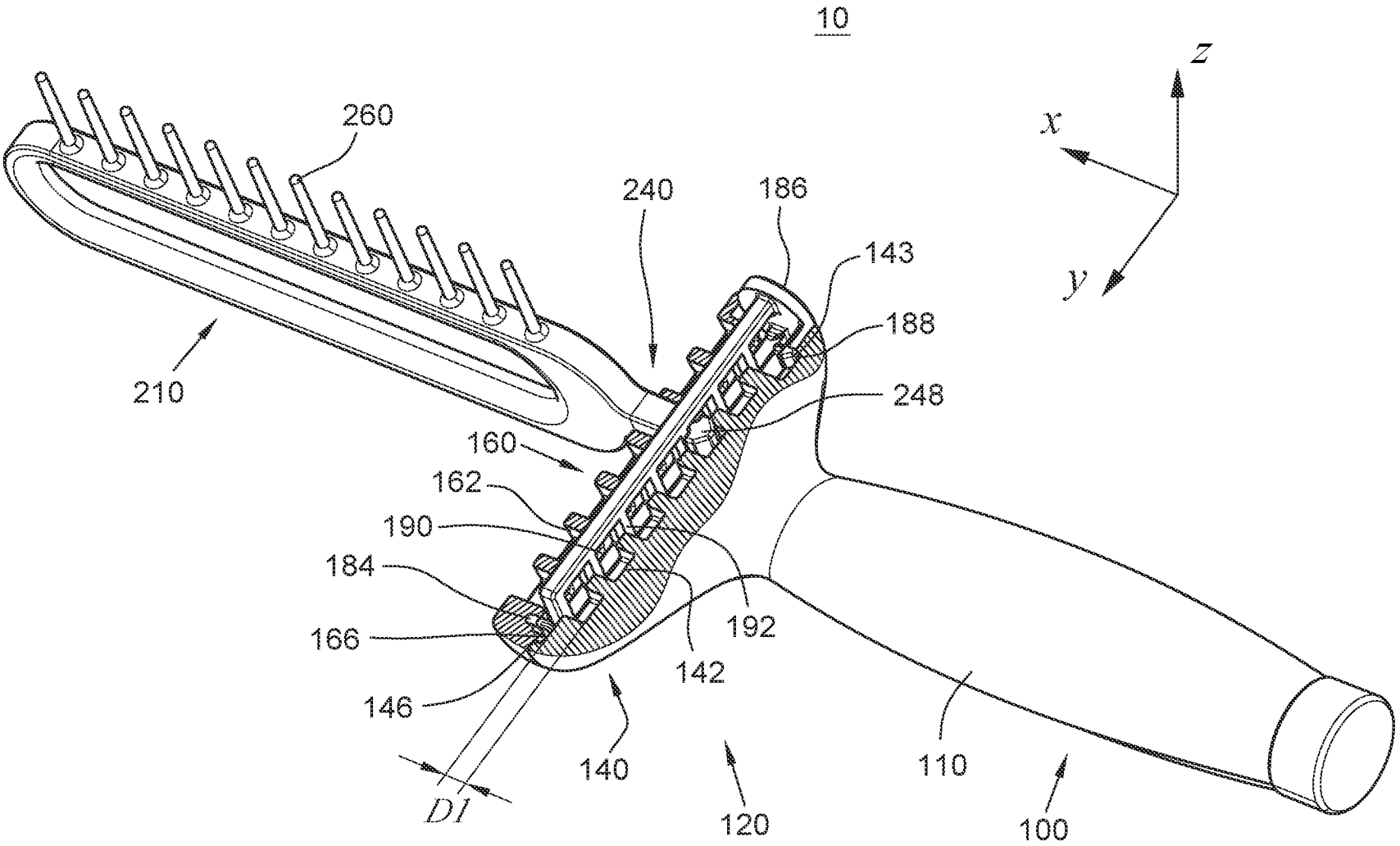
FIG. 7 is a perspective view illustrating a cutaway section in the hairbrush of FIG. 1 with some of the bristle structures being omitted.
Figure 8:
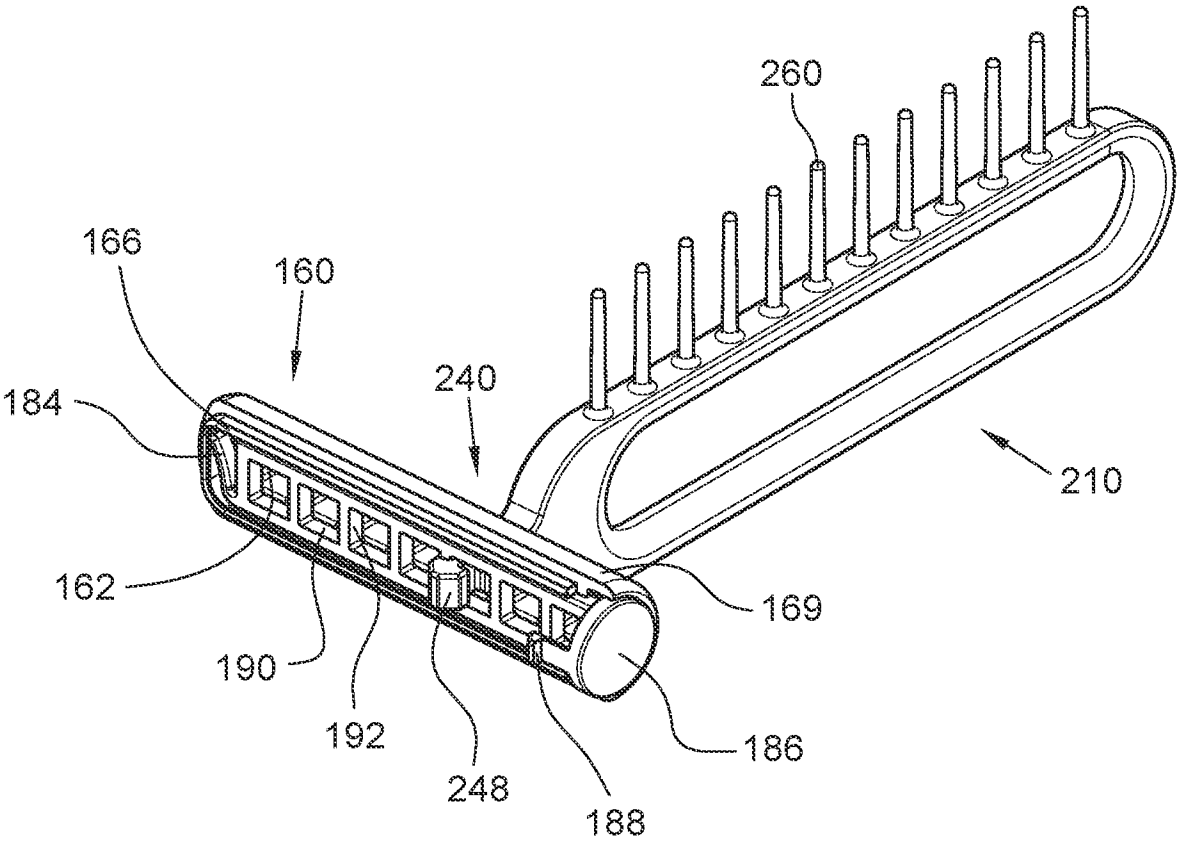
FIG. 8 is a perspective view illustrating a part of the hairbrush of FIG. 1.

Referring to FIGS. 4 and 7, the end portion 120 of the base 100 includes a first body part 140 extending substantially in the second direction Y, a second body part 160 extending substantially in the second direction Y, and a locking bar 180.

Figure 5:
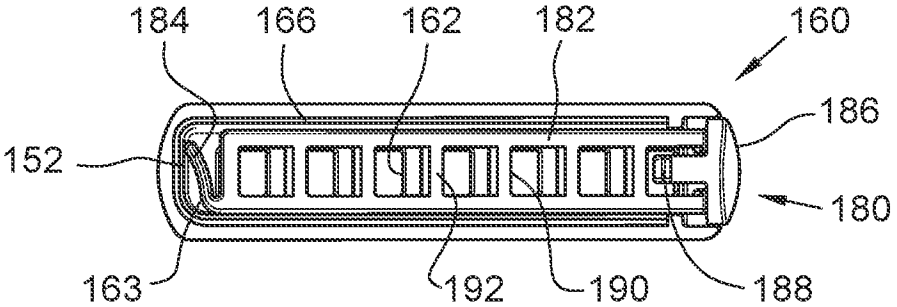
FIG. 5 is a side view illustrating a bristle connection mechanism of the hairbrush of FIG. 1 in a first state.
Figure 6:
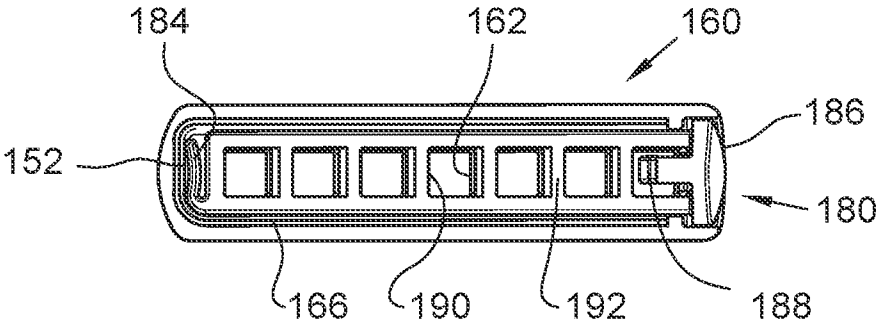
FIG. 6 is a side view illustrating the bristle connection mechanism of the hairbrush of FIG. 1 in a second state.

Referring to FIGS. 4-6, an interior cavity 150 is formed in the end portion 120 of the base 100 between the first and second body parts 140 and 160. Referring to FIG. 4, the interior cavity 150 extends substantially in the second direction Y, and has an open end accessible from a lateral side surface of the end portion 120 and a closed end portion 152 opposite to the end portion 120.

As illustrated in FIGS. 4 and 7, the locking bar 180 may be slidably disposed in the interior cavity 150, and may extend substantially in the second direction Y inside of the cavity 150.

The first and second body parts 140 and 160 and the locking bar 180 may be made of, for example, a metal, a polymeric material, wood, or a combination thereof. Metals that may be used to construct the first and second body parts 140 and 160 and the locking bar 180 include, for example, aluminum, copper, zinc, tin, iron, titanium, magnesium, etc., or alloys thereof (e.g., brass).

Polymeric materials that may be used to construct the first and second body parts 140 and 160 and the locking bar 180 include, for example, polyvinyl chloride (PVC), polycarbonate, PET, polyurethane, etc., or blends thereof.

Referring to FIG. 4, the first body part 140 may include a first end 145, a second end 147, an outer side surface 149 extending between the first and second ends 147, a plurality of recesses 142 extending inwardly into the first body part 140 from the outer surface 149 (e.g., extending in a direction opposite to the first direction X), and a coupling component 146 that protrudes from the outer side surface 149, in the first direction X, along a major portion of an outer periphery of the outer side surface 149.

As illustrated in FIG. 4, the recesses 142 may be spaced apart from one another and may be sequentially arranged in the second direction Y (e.g., in a length direction of the end portion 120 of the base 100). For example, the recesses 142 may be evenly spaced from one another.

Referring to FIG. 4, each one of the recesses 142 may have a plurality of side surfaces 144. The side surfaces 144 define a height H2 (measured in the third direction Z), a width W5 (measured in the second direction Y) and a depth D1 (measured in the first direction X, see FIG. 7 for the depth D1) of each recess 142. Each recess 142 is configured to fit the first body portion 248 of an elongated member 240 inside, and may form a wobble-free fit with the first body portion 248. Each recess 142 may, for example, be configured to form an interference fit with a first body portions 248 inserted therein. However, if desired, each recess 142 may also have a greater size than its respective first body portion 248 in order to loosely fit the first body portion 248 inside.

In an example, the height H2 and the width W5 of each recess 142, respectively, may be substantially equal to or slightly greater than the height H1 and the width W2 of the first body portion 248. The depth D1 of each recess 142 may be made long enough to accommodate the length of its respective first body portion 248.

The recesses 142 are illustrated as having a substantially square shape (or square cross-sectional shape), but the present invention is not limited to this configuration. For example the recesses 142 may have a polygonal shape, or an opening with a polygonal cross-sectional shape (e.g., a triangular cross-sectional shape, a rectangular cross-sectional shape, a pentagonal cross-sectional shape, etc.), a circular cross-sectional shape, a cross-sectional elliptical shape, an oval cross-sectional shape, or an irregular cross-sectional shape.

The locking bar 180 can be slid in the cavity 150 in order to enable the bristle structures 200 to be inserted and selectively coupled to the base 100, and to enable the bristle structures 200 to be selectively uncoupled from the base 100. For example, as can be gleaned with reference to FIGS. 4-8, the locking bar 180 can be slid between a first position in the cavity 150, illustrated in FIG. 6, in order to allow the bristle structures 200 to be coupled to and uncoupled from the base 100, and a second position, illustrated in FIGS. 5 and 7, in order to selectively lock the inserted bristle structures 200 to the base 100.

As illustrated in FIG. 4, the locking bar 180 may include a bar body 182 extending substantially in the second direction Y, a spring member 184 disposed at a first end of the bar body 182, and a button 186 with a tab 188 disposed at a second end of the bar body 182.

As illustrated in FIG. 4, the bar body 182 may include a plurality of through openings 190 along its length and a plurality of wall portions 192 extending between the through openings 190. Referring to FIG. 4, the through openings 190 are configured to allow the first body portion 248 of an elongated member 240 of a respective bristle structure 200 to pass through the bar body 182. In addition, each through opening 190 is configured to house the third body portion 252 of an elongated member 240 of a respective bristle structure 200 therein.

As illustrated in FIG. 4, each through opening 190 may have a width W6 that is substantially equal to or greater than the width W2 of the first body portion 248, and a height H3 that is substantially equal to or greater than the height H1 of the elongated member 240 of a respective bristle structure 200. For example, the through openings 190 may have a shape similar to or the same as the shape of the recesses 142.

As can be gleaned with reference to FIGS. 4-8, the locking bar 180 may rest naturally in the second position (see FIG. 5) due to the biasing action of the spring member 184 (e.g., due to the spring member 184 pressing against the end portion 152 of the cavity 150).

The locking bar 180 may be moved (e.g., slid) to the first position, for example, by depressing the button 186 inwardly toward the end portion 152 of the cavity 150 (e.g., depressing the button 186 in the second direction Y). The sliding action may cause the spring member 184 to be compressed, or deflected closer to the bar body 182, as illustrated in FIG. 6. When the button 186 is released, the locking bar 180 may slide back to the second position due to the biasing spring action of the spring member 184 (e.g., due to decompression of the spring member 184).

The spring member 184 is illustrated as being an elongated curved spring, but the present invention is not limited to this configuration. For example, the spring member 184 can also be a coil-type spring. In this case, the coil spring would have one end thereof attached to the bar body 182 and the other end configured to be pressed against the end portion 152 of the cavity 150. However, the spring member 184 can also be attached to other locations of the bar body 182 and can be configured to press against other areas of the end portion 120 surrounding the cavity 150.

As more clearly illustrated in FIGS. 4 and 7, the tab 188 is disposed in the cavity 150, and is configured to contact a portion 143 of the first body part 140 of the end portion 120 of the base 100 when the locking bar 180 is in the second position, (see FIG. 7). By contacting the portion 143, the tab 188 prevents the locking bar 180 from being ejected from the cavity 150.

Referring to FIGS. 4 and 7, the second body part 160 of the end portion 120 of the base 100 may include a first end 165, a second end 167, an inner side surface 163 (see FIG. 5) extending between the first and second ends 165 and 167, an outer side surface 169 (see FIG. 4) extending between the first and second ends 165 and 167, a plurality of through openings 190 along its length, and a coupling component 166 that protrudes from the inner side surface 163, in a direction opposite to the first direction X, along a major portion of an outer periphery of the inner side surface 163. The through openings 190 extend in the first direction X between the inner and outer side surfaces 163 and 169.

The interior cavity 150 is formed between the outer side surface 149 of the first body part 140 and the inner side surface 163 of the second body part 160. As illustrated in FIG. 7, the coupling components 146 and 166 are configured to be selectively connected to one another in order to maintain the first and second body parts 140 and 160 attached to one another.

For example, the coupling components 146 and 166 may form an interference fit, a snap fit, etc., with one another in order to maintain the first and second body parts 140 and 160 attached to one another. In addition, or alternatively, the coupling components 146 and 166 may be adhered to one another in order to maintain the first and second body parts 140 and 160 attached to one another.

As illustrated in FIGS. 4 and 7, the first and second body parts 140 and 160 of the end portion 120 of the base 100 may be two separate components that are selectively connectable to one another along their respective outer peripheries via various connection mechanisms. However, the present invention is not limited to this configuration of the base 100. For example, the first and second body parts 140 and 160 can also be formed as one integral structure. This configuration can be achieved, for example, by utilizing an injection molding process to inject a polymeric substance into a mold that creates the base 100 as a one-piece structure.

As illustrated in FIG. 4, the through openings 162 may be aligned with the recesses 142 of the first body part 140 of the end portion 120. Each through opening 162 is configured to allow the first and third body portions 248 and 252 of the elongated member 240 of a bristle structure 200 to pass through the second body part 160. In addition, each through opening 162 is configured to accommodate the second body portion 250 of an elongated member 240 therein.

Referring to FIG. 4, the through openings 162 may have a width W7 that is substantially equal to or greater than the width W3 of the second body portion 250 of an elongated member 240, and a height H3 that is substantially equal to or greater than the height H1 of the elongated member 240 of a bristle structure 200. For example, the through openings 162 may have the same shape as or a shape similar to the shape of the recesses 142 and/or the through openings 190 in the locking bar 180.

Each through opening 162 and its corresponding recess 142 defines a slot (or insertion slot) in the elongated end portion 120, and each slot is configured to receive the elongated member 240 of a bristle structure 200 inside. The cavity 150 may intersect all of the slots of the elongated end portion 120, as illustrated in FIG. 7. Referring to FIGS. 4 and 7, the slots may extend substantially parallel to one another and may be spaced apart evenly from one another. Thus, the bristle structures 200 that are connected to the slots may also extend in parallel to one another.

While FIG. 7 illustrates that the insertion slots may extend in parallel to one another inside of the end portion 120 of the base 100, and may have the same shape and the same length as one another, the present invention is not limited to this configuration. For example, the insertion slots may also extend at an oblique angle relative to one another and/or may have different lengths inside of the end portion 120 of the base 100. In addition, the spacing between the insertion slots need not be uniform, as that illustrated in FIG. 7.

When the locking bar 180 is in the first position, as illustrated in FIG. 6, the wall portions 192 either do not overlap with the through openings 162, or overlap the through openings 162 minimally. For example, FIG. 6 illustrates minimal (or negligible) overlapping between the wall portions 192 and the through openings 162. In other words, the first wall portions 192 of the bar body 182 of the locking bar 180 overlaps the slots to a degree that is insufficient to prevent the elongated member 240 of the first bristle structure 200 from being selectively inserted in or removed from its respective slot. This position enables the bristle structures 200 to be selective coupled to the base 100 by inserting the elongated member 240 of each separate bristle structure 200 into a slot of the elongated member 120 of the base 100. The first positon of the locking bar 180 also enables the bristle structures 200 to be selectively removed from their slots.

When the locking bar 180 is in the second position, as illustrated in FIG. 5, in each slot of the end portion 120, each wall portion 192 overlaps its respective through opening 162 to a degree that is sufficient for the wall portion 192 to be inserted in the second notch 256 of a bristle structure 200 that is inserted in that slot. In other words, when the locking bar 180 is in the second positon, the wall portions 192 are inserted in the second notches 256 of the bristles structures 200 that are coupled to the base 100 in order to prevent the bristle structures 200 from being uncoupled from the base 100.

Since each bristle structure 200 may include a pair of notches, (e.g., first and second notches 254 and 256), each bristle structure 200 can also be loaded in any one of the slots of the base 100 in an upside down alignment (e.g., with the bristle elements 260 pointing downwardly, opposite to the alignment illustrated in FIG. 4), in addition to the upwardly alignment illustrated in FIG. 4. When the bristle structures 200 are inserted in the slots of the base 100 in the upside down alignment, the wall portions 192 would be inserted in the first notches 254 of the bristle structures 200.

Referring back to FIG. 3, the first body portion 248 may be tapered at an end portion thereof that corresponds to the first end 242 of the elongated member 240 (or have its corners chamfered, resulting in a V-like shape with a flat bottom as more clearly illustrated in FIG. 3). The tapered end of the first body portion 248 enables the elongated member 240 of a bristle structure 200 to be inserted into any one of the slots of the elongated end portion 120 by grasping a bristle structure 200, inserting the first portion 248 thereof into a slot, and pushing (with some force) the bristle structure 200 into the slot. In other words, a user would not need to depress the button 186 to move the wall portions 192 of the locking bar 180 out of the slots in order to clear the path for the elongated member 240 to be inserted inside of the slot.

This is so because the slanted surface of one of the chamfered corners of the first body portion 248 is configured to contact the wall portion 192 inside of the slot where the elongated member 240 is inserted, and to cause the wall portion 192 inside of the slot (and therefore the entire locking bar 180) to be moved (e.g., slid) in the Y direction away from the first body portion 248 when the bristle structure 200 is pressed inwardly into the slot. This, in turn, enables the first body portion 248 to pass through its respective through opening 190 and to continue being inserted deeper into the slot.

When the first body portion 248 of a bristle structure 200 passes beyond the depth of the locking bar 180 inside of the slot, the locking bar 180 then springs back in the —Y direction and lodges inside of one of the first and second notches 254 and 256 of that bristle structure 200 (as the case may be, depending on whether the bristle structure 200 is inserted with the bristle elements 260 pointing upwardly (e.g., in the Z direction), or downwardly, in the (−Z direction)) due to the action of the spring member 184.

Alternatively, or in addition, the button 186 can be depressed by a user in order to move the wall portions 192 away from the slots (e.g., in the Y direction) in order to enable the elongated member 240 of each bristle structure 200 to be inserted (or removed) into a slot.

FIG. 1 illustrates that the elongated member 240 of each bristle structure 200 is long enough to prevent the outer surface 218 of the hollow body 210 of each bristle structure 200 from contacting the outer side surface 169 of the second body part 160 of the end portion 120 of the base 100. However, the present invention is not limited to this configuration, and the length of the elongated members 240 and/or the lengths of the slots can be modified such that the outer surface 218 of the hollow body 210 of the bristle structures 200 can make contact with the outer side surface 169 of the second body part 160 of the end portion 120.

When the outer surface 218 of the hollow body 210 of the bristle structures 200 contacts the outer side surface 169 of the second body part 160 of the end portion 120, the area where these two surfaces contact one another provides additional structural support for the bristle structures 200. The additional structural support results in increased stability of the bristle structures 200 when utilizing the hairbrush 10, thereby, preventing or at least minimizing any side-to-side or upwardly and downwardly rocking/bending motion of the bristle structures 200 when the hairbrush 10 is in use (e.g., due to the forces exerted on the bristle structures 200 when combing/brushing hair).

The shape and/or size of the outer surface 218 of the hollow body 210 of the bristle structures 200 as well as the shape and/or size of the outer side surface 169 of the second body part 160 of the end portion 120 can be modified as needed to increase the stability of the bristle structures 200. For example, the hollow body 210 can be manufactured to be wider than that illustrated in FIGS. 1-8.

In addition, or alternatively, the outer side surface 169 of the second body part 160 of the end portion 120 can be made flat or otherwise be manufactured to have a shape that matches the shape of the hollow body 210 in order to increase the contact area between the outer surface 218 of the hollow body 210 and the outer side surface 169 of the second body part 160 of the end portion 120.

Figure 10:
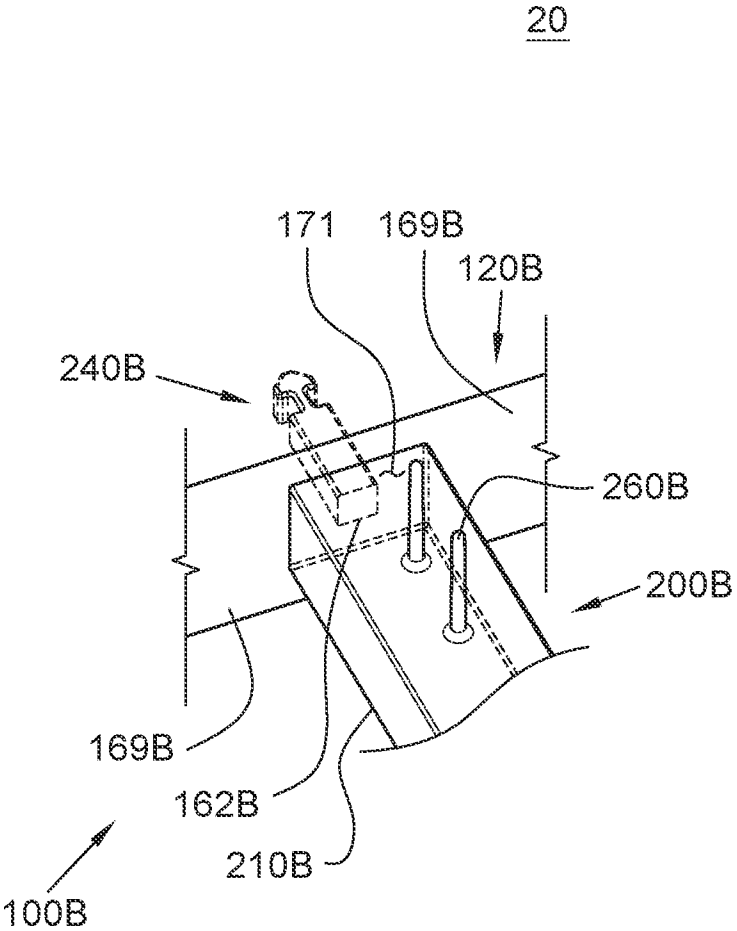
FIG. 10 is a perspective view illustrating a portion of a hairbrush according to an exemplary embodiment of the present invention.

This configuration is illustrated with reference to FIG. 10. FIG. 10 illustrates a portion of a hairbrush 20 of the present invention. Referring to FIG. 10, the hairbrush 20 includes a base 100B with an end portion 120B, the end portion 120B having an outer side surface area 169B, and a bristle structure 200B selectively connected to the end portion 120B.

Referring to FIG. 10, the bristle structure 200B includes an elongated member 240B selectively inserted into the end portion 120B, and a body 210B with bristle elements 260B attached to the elongated member 240B.

Referring to FIG. 10, the outer side surface 169B may be flat, and may have a through opening 162B of a slot. As illustrated in FIG. 10, an end portion of the body 210B that faces the outer side surface 169B may be configured to rest substantially against the outer side surface 169B when the bristle structure 200B is selectively connected to the end portion 120B.

As illustrated in FIG. 10, the end portion of the body 210B that is configured to rest on the outer side surface 169B may be flat and may be wider than the size of the through opening 162B. The area where the end portion of the body 210B overlaps with and contacts the outer side surface 169B is denoted by reference numeral 171 in FIG. 10. The area 171 increases the stability of the bristle structure 200B when the bristle structure 200B is connected to the end portion 120B.

Components of the hairbrush 20 not described in detail herein may be assumed to be similar to or the same as corresponding components of hairbrush 10.

Figure 11:
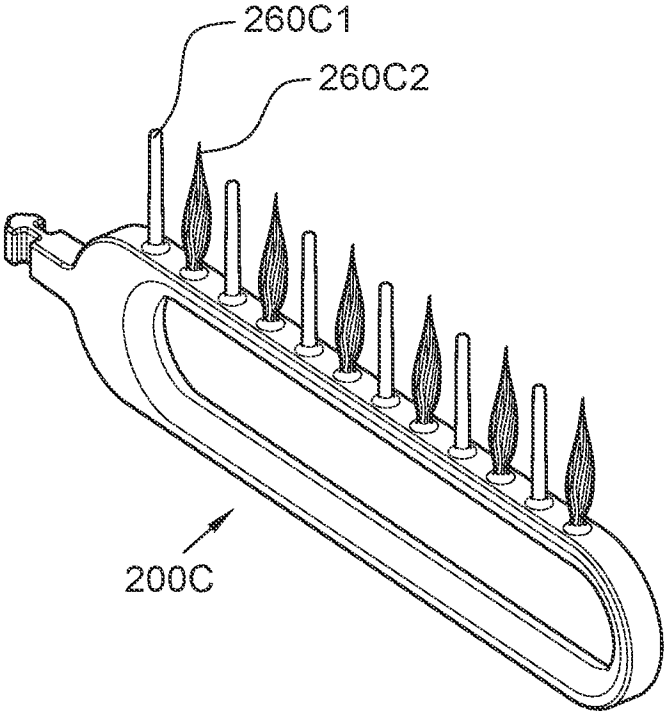
FIG. 11 is a perspective view illustrating a bristle structure according to an exemplary embodiment of the present invention.

As described above, a base of a hairbrush (e.g., the base 100) can be coupled with different kinds of bristle structures 200 in order to best serve the kind of hair that the hairbrush will be used to comb/brush. The bristle structures 200 can have different lengths and different bristle configurations. For example, FIG. 11 illustrates a bristle structure 200C that includes a plurality of bristle elements 260C1 and a plurality of bristle elements 260C2 alternatively arranged with one another along a length of the bristle structure 200C. The bristle elements 260C1 may be individual brush tips, and the bristle elements 260C2 may be tufts of bristles (e.g., a plurality of boar's hairs or other hairs bundled together).

Figure 12:
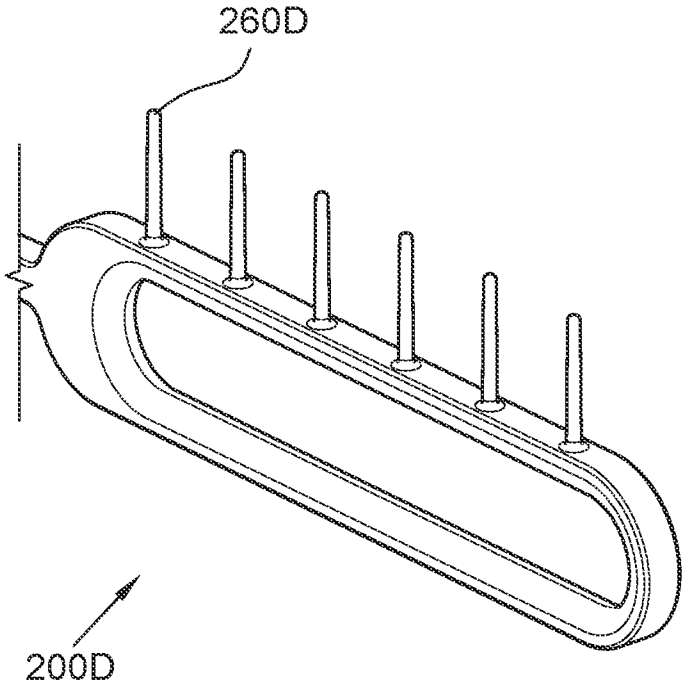
FIG. 12 is a perspective view illustrating a bristle structure according to an exemplary embodiment of the present invention.

FIG. 12 illustrates a bristle structure 200D that has half of the density of bristle elements 260D than the bristle structure 200. For example, the bristle structure 200D may have the same length as the bristle structure 200 but the bristle elements 260D in the bristle structure 200D may be spaced apart from one another by twice the distance between the bristle elements 260 of bristle structure 200.

Figure 13:
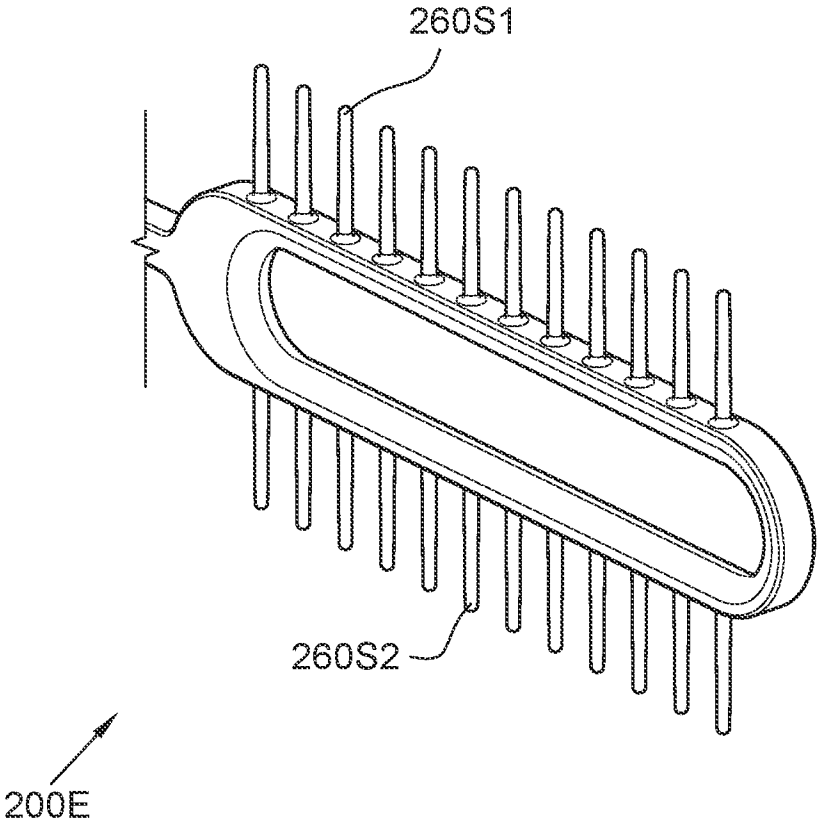
FIG. 13 is a perspective view illustrating a bristle structure according to an exemplary embodiment of the present invention.

FIG. 13 illustrates a bristle structure 200E that has bristle structures on two opposite sides thereof (e.g., on its top and bottom sides). Referring to FIG. 13, the bristle structure 200E includes a plurality of bristle elements 260S1 on its top side and a plurality of bristle elements S2 on its bottom side. In FIG. 13 is it illustrated that the bristle elements 260S1 are the same as the bristle elements 260S2, but the present invention is not limited to this configuration. The bristle structure 200E can also be configured to have bristle elements 260S1 that are different from the bristle elements 260S2.

While the hairbrush 10 of FIGS. 1-8 is illustrated as having seven slots configured to receive bristle structures 200, the present invention is not limited to this configuration. A hairbrush of the present invention can be provided with one slot if desired, or with more than one slot.

In addition, the hairbrush 10 of FIGS. 1-8 can also be turned into a dual-sided hairbrush by coupling some of the bristle structures 200 in the upwardly alignment, as illustrated in FIG. 4 (e.g., pointing upwardly in the Z direction), and by coupling other bristle structures 200 in the downwardly alignment (e.g., pointing downwardly in a −Z direction). The symmetrical structure of the elongated member 240 and slots allow this. The elongated member 240 and slots may be non-symmetrical (e.g. triangular cross-section) such that the bristle structures 200 can only be inserted one way (e.g. upward Z direction), but not the other (e.g. downward Z direction). Alternatively, or in addition, the hairbrush 10 can be turned into a dual-sided hairbrush by coupling one or more dual-sided bristle structures 200E to it. The dual-sided hairbrush configuration can be useful, for example, when loading the hairbrush 10 with different bristle elements on different sides of the hairbrush. When the hairbrush 10 is loaded with different bristle elements on two of its sides, a single hairbrush 10 can effectively be used as two separate hairbrushes. This configuration is convenient because it spares the user the cost of purchasing and storing two separate hairbrushes (which would require two separate bases/handles).

In addition, the through opening 219 in the hollow body 210 of each bristle structure 200 is useful because it reduces the weight of the bristle structures 200 and enables the bristle structures 200 to be hooked to a wall or other supporting surface via a hook.

However, the bristle structures of a hairbrush 10 of the present invention need not necessarily feature the through openings 219.

Figure 9:
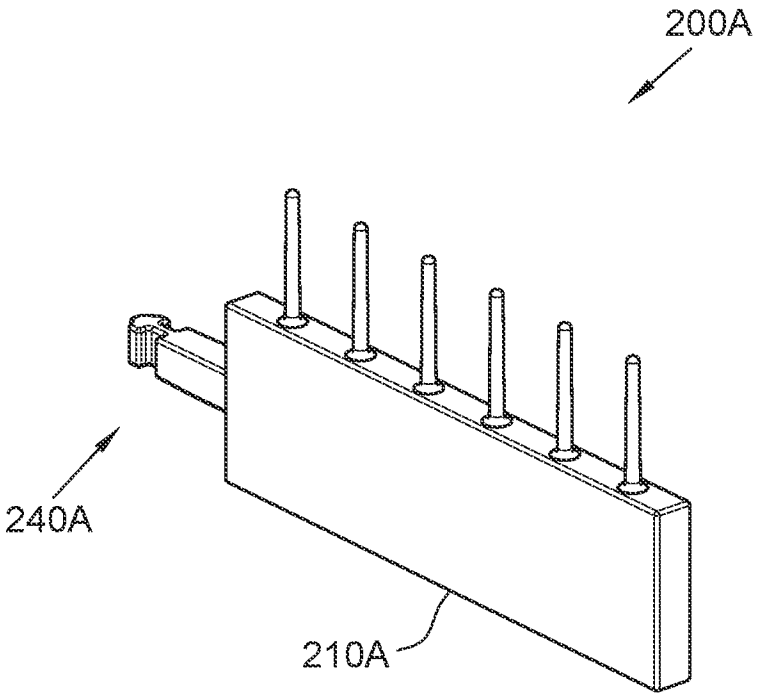
FIG. 9 is a perspective view illustrating a bristle structure according to an exemplary embodiment of the present invention.

For example, FIG. 9 illustrates a bristle structure 200A that does not have a through opening 210. The bristle structure 200A may be coupled to and uncoupled from the base 100 of the hairbrush 10 of FIGS. 1-8 as described above for the bristle structures 200. Thus, the base 100 of the hairbrush 10 of FIGS. 1-8 can be loaded solely with bristle structure(s) 200, with a combination of bristle structure(s) 200 and bristle structures 200A, or solely with bristle structure(s) 200A.

Referring to FIG. 9, the bristle structure 200A may have a bar-shaped body 210A and an elongated member 240A. The bar-shaped body 210A may be solid or may be hollow on the inside, but does not have any through openings. When the body 210A is hollow on its inside, all of its end faces may be closed in order to avoid forming openings through the body 210A.

While the body 210A of the bristle structure 200A is illustrated as having square ends, the present invention is not limited to this configuration. For example, the body of a bristle structure of the present invention can be manufactured to have different end shapes, for example, rounded ends as illustrated in FIG. 2 for the bristle structures 200, square ends as illustrated in FIG. 9, or ends having other shapes.

The elongated member 240A may be similar to or the same as the elongated member 240 described above.

It becomes apparent from the description above that a hairbrush of the present invention is highly customizable. The hairbrush can be provided with a desired number of slots, and can be customized by a user by selecting the desired number and type of bristle structures, and coupling the selected bristle structures to desired slots in the base of the hairbrush.

While the present invention has been particularly shown and described with reference to exemplary embodiments thereof, it will be apparent to those of ordinary skill in the art that various changes in form and detail may be made therein without departing from the spirit and scope of the present invention.

What is claimed is:

1. A hairbrush comprising:

a base with an elongated end portion, wherein the elongated end portion of the base includes:

a body with a front side surface and a lateral side surface;

a first slot extending from the front side surface in a first direction inside of the body; and a cavity extending from the lateral side surface in a second direction inside of the body, wherein the first and second directions cross one another, and wherein the cavity and the first slot intersect one another inside of the body of the elongated end portion;

a first bristle structure configured to be selectively coupled to the elongated end portion of the base by being inserted into the first slot; and means disposed in the cavity for allowing the first bristle structure to be selectively inserted into the slot, for maintaining the bristle structure connected to the slot once inserted therein, and for allowing the first bristle structure to be selectively removed from the slot, wherein the body of the first bristle structure includes an opening extending therethrough.

2. The hairbrush of claim 1, wherein the means disposed in the cavity include a locking bar disposed in the cavity, wherein the locking bar is configured to move between a first position and a second position within the cavity, wherein the locking bar includes a bar body with a first end and a second end, wherein the bar body has a length in the second direction between the first and second ends thereof, a width in a third direction that crosses the first and second directions, and a thickness in the first direction, and wherein the bar body includes a first through opening extending in the first direction and a first wall portion bordering a side of the first through opening; and wherein the first bristle structure includes:

a body with a plurality of bristle elements; and an elongated member connected to the body of the first bristle structure, wherein the elongated member extends in the first direction and includes a first end opposite to the body of the first bristle structure, a second end connected to the body of the first bristle structure, and a first notch disposed between the first and second ends thereof, wherein, when the locking bar is in the first position with the elongated member of the first bristle structure inserted in the first slot, the elongated member of the first bristle structure extends through the first through opening of the bar body of the locking bar with the first wall portion of the bar body of the locking bar positioned inside of the first notch in order to maintain the first bristle structure selectively connected to the base, and wherein, when the locking bar is in the second position, the first wall portion of the bar body of the locking bar is positioned outside of the first notch in order to allow the elongated member of the first bristle structure to be selectively removed from the first slot.

3. The hairbrush of claim 2, wherein the elongated member of the body of the first bristle structure further includes a second notch disposed opposite to the first notch.

4. The hairbrush of claim 2, wherein the elongated end portion of the base further includes a second slot separated from the first slot, wherein the second slot extends from the front side surface of the body of the elongated end portion of the base in the first direction inside of the body of the elongated end portion of the base, and wherein the second slot intersects the cavity inside of the body of the elongated end portion.

5. The hairbrush of claim 4, further comprising a second bristle structure configured to be selectively coupled to the elongated end portion of the base, wherein the bar body of the locking bar further includes a second through opening extending in the first direction and a second wall portion bordering a side of the first through opening, wherein the second bristle structure includes:

a body with a plurality of bristle elements; and an elongated member connected to the body of the second bristle structure, wherein the elongated member extends in the first direction and includes a first end opposite to the body of the second bristle structure, a second end connected to the body of the second bristle structure, and notch disposed between the first and second ends thereof, wherein, when the locking bar is in the first position with the elongated member of the second bristle structure inserted in the second slot, the elongated member of the second bristle structure extends through the second through opening of the bar body of the locking bar with the second wall portion of the bar body of the locking bar positioned inside of the notch of the second bristle structure in order to maintain the second bristle structure selectively connected to the base, and wherein, when the locking bar is in the second position, the second wall portion of the bar body of the locking bar is positioned outside of the notch of the second bristle structure in order to allow the elongated member of the second bristle structure to be selectively removed from the second slot.

6. The hairbrush of claim 4, wherein the first and second slots extend substantially parallel to one another.

7. The hairbrush of claim 6, wherein, the first and second slots have a same cross-sectional shape as one another.

8. The hairbrush of claim 2, wherein the cavity includes a closed end portion inside of the base, wherein the locking bar further includes a spring member disposed at the second end of the bar body, the spring member being configured to contact the closed end portion of the cavity in order to bias the locking bar toward the first position when the locking bar is in the second position.

9. The hairbrush of claim 2, wherein the locking bar further includes a button disposed at the first end of the bar body, wherein the button is accessible from the lateral side surface of the body of the elongated end portion of the base.

10. The hairbrush of claim 9, wherein the locking bar further includes a tab connected to the bar body, wherein the tab is disposed inside of the cavity and is configured to prevent the locking bar from being removed from the cavity.

11. The hairbrush of claim 10, wherein the tab is disposed adjacent to the first end of the bar body.

12. The hairbrush of claim 1, wherein the first bristle structure has a plurality of first bristle elements extending upwardly from a top surface area of the first bristle structure, and a plurality of second bristle elements extending downwardly from a bottom surface area of the first bristle structure.

13. The hairbrush of claim 1, wherein the body of the first bristle structure includes a first end configured to face the front side surface of the body of the elongated end portion of the base, and a second end opposite to the first end thereof, wherein the first end of the body of the first bristle structure is wider than the first slot.

14. The hairbrush of claim 13, wherein the first end of the body of the first bristle structure is configured to contact the front side surface of the body of the elongated end portion of the base when the first bristle structure is inserted in the first slot.

15. A hairbrush comprising:

a base with an elongated end portion, wherein the elongated end portion of the base includes:

a body with a front side surface and a lateral side surface;

a plurality of slots separated from one another and extending from the front side surface in a first direction inside of the body;

a cavity extending from the lateral side surface in a second direction inside of the body, wherein the first and second directions cross one another, and wherein the cavity intersects the plurality of slots inside of the body of the elongated end portion;

a locking bar disposed in the cavity and configured to slide between a first position and a second position within the cavity, wherein the locking bar includes a bar body with a first end and a second end, wherein the bar body has a length in the second direction between the first and second ends thereof, a width in a third direction that crosses the first and second directions, and a thickness in the first direction, wherein the bar body includes a plurality of through openings extending through the bar body in the first direction, and a wall portion bordering a side of a respective one of the through opening of the bar body; and a plurality of bristle structures configured to be selectively coupled to the elongated end portion of the base, wherein each one of the bristle structures includes:

a body with a plurality of bristle elements; and an elongated member connected to the body the bristle structure, wherein the elongated member of each bristle structure extends in the first direction and includes a first end opposite to the body of the respective bristle structure, a second end connected to the body of the respective bristle structure, and a first notch disposed between the first and second ends of the elongated member, wherein, when the locking bar is in the first position with the elongated member of each bristle structure of the plurality of bristle structures inserted in a respective slot of the plurality of slots and extending through a respective through opening of the plurality of through openings of the bar body, a respective wall portion of the plurality of wall portions of the bar body of the locking bar is positioned inside of the first notch of each bristle structure in order to maintain the plurality of bristle structures selectively connected to the base, and wherein, when the locking bar is in the second position, the wall portions of the bar body of the locking bar are positioned outside of the first notches in order to allow the plurality of bristle structures from being removed from the slots.

16. The hairbrush of claim 15, wherein the elongated member of a first one of the plurality of bristle elements has a cuboid shape.

17. The hairbrush of claim 15, wherein the elongated member of a first one of the plurality of bristle elements further includes a second notch.

18. The hairbrush of claim 15, wherein a size of a first one of the slots is approximately equal to a size of the elongated member of a first one of the bristle elements such that the first one of the slots and the elongated member of the first one of the bristle elements can form an interference fit with one another.

19. A hairbrush comprising:

a base with an elongated end portion, wherein the elongated end portion of the base includes:

a body with a front side surface and a lateral side surface;

a first slot extending from the front side surface in a first direction inside of the body; and a cavity extending from the lateral side surface in a second direction inside of the body, wherein the first and second directions cross one another, and wherein the cavity and the first slot intersect one another inside of the body of the elongated end portion;

a first bristle structure configured to be selectively coupled to the elongated end portion of the base by being inserted into the first slot; and means disposed in the cavity for allowing the first bristle structure to be selectively inserted into the slot, for maintaining the bristle structure connected to the slot once inserted therein, and for allowing the first bristle structure to be selectively removed from the slot, wherein the body of the first bristle structure omits any openings therethrough.

* * * * *